US010428578B1

(12) United States Patent
Glaser

(10) Patent No.: US 10,428,578 B1
(45) Date of Patent: Oct. 1, 2019

(54) DEVICE FOR PREVENTING FLOODING IN SLIDING PATIO DOORS

(71) Applicant: Todd M. Glaser, Miami Beach, FL (US)

(72) Inventor: Todd M. Glaser, Miami Beach, FL (US)

( * ) Notice: Subject to any disclaimer, the term of this patent is extended or adjusted under 35 U.S.C. 154(b) by 0 days.

(21) Appl. No.: 16/041,791

(22) Filed: Jul. 22, 2018

Related U.S. Application Data

(60) Provisional application No. 62/687,124, filed on Jun. 19, 2018.

(51) Int. Cl.
*E02B 7/02* (2006.01)
*E06B 9/00* (2006.01)
*E02B 7/00* (2006.01)

(52) U.S. Cl.
CPC ..... *E06B 9/00* (2013.01); *E02B 7/005* (2013.01); *E06B 2009/007* (2013.01)

(58) Field of Classification Search
CPC ..... E06B 1/70; E06B 7/26; E06B 2009/007; E06B 9/00; E02B 7/005
See application file for complete search history.

(56) References Cited

U.S. PATENT DOCUMENTS 4,692,961 A * 9/1987 Brown ..... E06B 9/00 16/95 R
5,236,281 A * 8/1993 Middleton ..... B65D 90/24 404/14
5,820,297 A * 10/1998 Middleton ..... E02B 7/00 405/52
9,080,375 B2 * 7/2015 Fleeting ..... E06B 7/26
(Continued)

FOREIGN PATENT DOCUMENTS

GB 2283524 * 10/1995

OTHER PUBLICATIONS

Section 08390 Watertight Doors. (2016). [ebook] Grand Forks: PS Doors. Available at: https://www.psfloodbarriers.com/wp-content/uploads/sites/4/2016/09/Sliding_Flood_Barrier_Specification_112816-1.pdf [Accessed Jul. 18, 2018].
(Continued)

*Primary Examiner* — Carib A Oquendo
(74) *Attorney, Agent, or Firm* — Greg M. Popowitz; Assouline & Berlowe, P.A.

(57) ABSTRACT

A device prevents flooding under sliding patio doors by blocking the space between a bottom of a sliding door panel and the top of the sliding door track. The device includes a reshapeable base that fills an external portion of a track of the sliding door to prevent water from pooling in the track and then from being driven by wind under the door panel. The shapeable base is made of a heavy material such as a sandbag that prevents the shapeable base from being blown out of the track, even during hurricane force winds. The device further includes a declined portion that directs rainwater away from the outer surface of the door panel, beyond the outer rim of the track. The declined portion thereby prevents rainwater from collecting within the track by directing the rainwater outward, beyond the outer rim of the track. An assembly of a plurality of devices can be utilized to protect a sliding door that has multiple panels, In the case of the assembly, a respective device is provided for each of the door panels in the sliding door.

14 Claims, 5 Drawing Sheets

(56) References Cited

U.S. PATENT DOCUMENTS

| | | | | |
|---|---|---|---|---|
| 2010/0031578 | A1* | 2/2010 | Hartwell | E06B 1/70 49/468 |
| 2011/0016792 | A1* | 1/2011 | Verd Herrero | E06B 1/702 49/70 |
| 2014/0109482 | A1* | 4/2014 | Rakhmanin | E06B 9/00 49/463 |
| 2014/0193203 | A1* | 7/2014 | Richardson | E02B 3/127 405/116 |

OTHER PUBLICATIONS

LLC, S. (2018). Snake Sandbags™. [online] Snakesandbags.com. Available at: http://snakesandbags.com [Accessed Jul. 18, 2018].
Wiki.ezvid.com. (2018). Top 8 Flood Barriers of 2018 | Video Review. [online] Available at: https://wiki.ezvid.com/best-flood-barriers [Accessed Jul. 18, 2018].

* cited by examiner

DEVICE FOR PREVENTING FLOODING IN SLIDING PATIO DOORS

CROSS-REFERENCE TO RELATED APPLICATIONS

This application claims the benefit of U.S. Provisional Application No. 62/687,124, filed Jun. 19, 2018.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to devices for preventing flooding through sliding patio doors.

Description of the Related Art

FIG. 2 shows a sliding door 20 according to the prior art. The sliding door 20 has four door panels 21A, 21B, 21C, and 21D. A track 30 supports the door panels 21A, 21B, 21C, and 21B. The track 30 has an inner rim 31, an outer rim 33, and a base plate 35 spanning from the inner rim 31 and the outer rim 33. The inner rim 31 and the outer rim can be greater than seven centimeters (>7 cm tall). The top of the inner rim 31 is higher than the bottom of the door panels 21A, 21B, 21C, and 21D. Likewise, the top of the outer rim 33 is higher than the bottom of the door panels 21A, 21B, 21C, and 21D. Each of the door panels 21A, 21B, 21C, and 21D have a respective wheel 22A, 22B, 22C, and 22D. Each panel 21A, 21B, 21C, and 21D has a respective rail 32A, 32B, 32C, and 32D formed on the base plate 35. Each rail 32A, 32B, 32C, and 32D has a U-shaped cross section. The wheels 22A, 22B, 22C, and 22D roll in the U-shaped socket of their respective rail 32A, 32B, 32C, and 32D. The tops of the rails 32A, 32B, 32C, and 32D are lower than the tops of the inner rim 31 and the outer rim 33.

A first function of the inner rim 31 and the outer rim 33 is to prevent any of the panels from falling outside the track 30 even if the door panel 21A, 21B, 21C, or 21D falls off its respective rail 32A, 32, 32C, and 32D. A second function of the inner rim 31 is to prevent water that collects within the track 30 from entering the building. The outer rim 33 has a weep hole 34 or scupper to allow water that collects within the track 30 to drain outside the building.

Under normal conditions, most sliding doors 20 have a cover such as an awning, eve, or balcony above them. The cover prevents rainfall from falling into the track 30.

In hurricane winds, which can exceed two-hundred kilometers per hour (>200 kph), rain can be driven by wind into the track 30. The wind will blow debris 60 into the track 30.

The debris 60 can block the weep hole 34. When debris 60 clogs the weep hole 34, the water surface 41 of the water 40 will rise to the level of the top of the outer rim 33. Hurricane force winds (WIND) can drive water 40 that has accumulated in the track 30 under the door panels 21A, 21B, 21C, and 21D and over the inner rim 31 and onto flooring 50 within the building.

This process of pushing accumulated rainwater against a sliding door shows how water can enter a building during a hurricane even when the door panels 21A, 21B, 21C, and 21D are not breached.

Accordingly, a need exists for a device for preventing water from entering a track of a sliding patio door. In addition, for safety reasons, the device must allow occupants inside the building to be able to open the sliding patio door from inside the building to allow egress in case of emergency.

BRIEF SUMMARY OF THE INVENTION

An object of the invention is to provide a device for preventing flooding in buildings that have sliding patio doors that overcomes the disadvantages of the devices of this general type and of the prior art.

With the foregoing and other objects in view there is provided, in accordance with the invention, a device having a shapeable base and a declined body on the shapeable base is provided and to be used to prevent flooding under a sliding panel door. The reshapeable base is made of a heavy material that can be shaped and reshaped by a homeowner to fill a sliding door track. The material should be heavy enough to prevent the reshapeable base from blowing away in hurricane winds. The heavy material should not dissolve in water.

The declined portion is roughly shaped like a triangular prism with an inside surface and a declining outside surface. The inside surface rests against the door panel. As water strikes the declined body, the declined body prevents water from reaching the covered part of the door panel. The declined outside surface directs water running downward on the door panel outward, outside of the track.

In accordance with the objects of the invention, the device prevents water from being pushed by wind under the bypass panels of a sliding patio door. As stated, the device includes a base and a declined portion. The base is configured to rest in the track of the sliding door, outside (i.e. external) the external face of the sliding panel. The base has a mass great enough to prevent the base from dislodging from the track when exposed to hurricane wind. The base can weigh at least eighteen kilograms (>18 kg). The base support and connects to the declined portion. In use, a tall, vertical inner surface of the declined portion rests against the external face of the sliding door. The declined portion has a declined outer surface. When the device is installed and resting in the external portion of the track, the declined outer surface declines from the external face of the door panel. The base blocks water from being blown under the panel of the sliding door by blocking the gap between the top surface of the track and the bottom of the panel of the sliding door. In addition, the declined portion prevents rain from collecting in the track by directing water downward and away from the panel and outside the track.

The base and the declined portion are impervious to water. For example, the base can be a sandbag or a bag of metal (e.g. lead) pellets. An alternative material for the base is a block of clay covered with cloth. By being impervious to water, the base prevents water from passing under the panel of the sliding door.

The device can include an external cover that surrounds the reshapeable base and the declined portion together. The external cover can be shaped to match the outer surfaces of the reshapeable base and the declined portion. The external material can be made of a durable fabric: for example, rip-stop nylon.

The base can be reshapable. That is, the base is shapeable to allow the base to be pressed into a track of a sliding door to block the space beneath a panel of a sliding door. By being shapeable the base can conform with top surface of the underlying track and no gaps are created to allow water to collect. If the base is placed on the top track and the underlying top surface has rails or if the base rests on the outer rim of the track, the base conforms to those shapes and prevents water from flowing between the bottom of the base and the top of the track, which in turn prevents water from being blown under the panel of the sliding door. The base is reshapable because the device can be removed from the track and placed on a different track that has a top surface with a different shape and the end user can reshape the base to conform to the differently shaped second track. By being shapeable, the base can conform to the shape of the tope surface of the track.

A bag filled with particles can provide a shapeable base. Particles with a collective heavy mass can be used to form a shapeable base that will not blow away in hurricane winds. "Collective mass" is meant to mean that although the individual particles might weigh very little, collectively, all of the particles in the bag add to a large mass. Examples of particles that can be used to create a heavy collective mass include sand and metal (e.g. lead) shot. A base that uses lighter particles (e.g. polystyrene foam particles) can be combined with a weight (e.g. a metal plate) on top of the bag of lighter particles, to provide a base that is both reshapeable and massive. The term reshapeable is intended to mean that an end user (e.g. home, condominium, or apartment owner or occupant) can remove the device and place it on a different track having a different shape and the base of the device has a reshapeable property that allows the base to conform with a different track shape or different track placement without needing the device to be retooled or remanufactured by anyone but the end user.

The base of the device can be configured to have a depth that is at least as great as a depth between the external face of the sliding door and the outer rim of the track. The depth of the base is defined, in terms of when the device is installed, as the distance from the outermost (i.e. exterior, far from the sliding door) location of the base to the innermost (i.e. closer to the sliding door) location of the base.

The depth of the base can be equal to the depth between the external face of the sliding door and the outer rim of the track. When the base has an equal depth, the base will abut both the external face of the sliding door and the outer rim of the track and fill that space when installed in the track. By filling the portion of the track outside the sliding door panel with the base, water cannot accumulate in the track. As a result, the device works to both block the gap between the sliding door and the track and to prevent water from pooling in the track. Without a pool of water in the track, the wind cannot push water under the sliding door and over the inner rim of the track. When the base and the declined portion are the same depth as the distance between the exterior of the sliding door and the outer rim of the track, the declined surface will direct rainwater to fall outside the track. Directing the water that is striking and running down an upper uncovered part of the sliding door and the water that is striking the exterior of the device, to a location outside, beyond the track, decreases the risk of water pooling in the track.

The depth of the base can be can be greater than the depth between the external face of the sliding door and the outer rim. In such a case, the base is conformed to the part of the track that is on the outside of the sliding door panel. The outer edge of the base may extend further outside the outer rim of the track. The declined surface directs rainwater to fall outside the track. Directing the water that is striking and running down an upper uncovered part of the sliding door and the water that is striking the exterior of the device, to a location outside, beyond the track, decreases the risk of water pooling in the track.

In cases where the depth of the base is less than the depth between the external face of the sliding door and the outer rim, the device will work to block gap between the bottom of the sliding door panel and the top of the track. However, the device will tend to fill outermost portion of the track with water draining from the device.

The width of the device is equal to the width of the sliding door. By being the same width, the entire gap between the bottom of the sliding door and the top of the track is blocked by the device. Most sliding patio doors include two or more panels. In this case, one device can be spanned across all of the panels of the sliding door. As an alternative, an assembly of devices can be used. The assembly combines a respective device for each of the panels in the sliding door. Each device has a width equal to a width of a respective panel. Because the panels overlap each other, the width of a respective device is actually the width of the panel less the amount of any overlap by another panel. By using a device for each panel, each device can abut the full width of the underlying panel and no gaps are possible.

The height of the device, that is the combined height of the base and the declined portion must be greater than the gap between the bottom of the sliding door and the top of the track so that the device can completely block the gap. Because the base needs to have sufficient weight and the declined portion needs to be tall enough to provide a sufficient decline to encourage runoff, a device is typically at least sixty centimeters (>60 cm) at the devices tallest point.

The invention includes an assembly for preventing flooding under a sliding door. The assembly is composed of a plurality of devices like those previously described. The assembly includes a respective device for each panel of the sliding door. The devices are placed side by side against each the adjacent device. Each device is placed on the track, against the outer face of its respective panel. The assembly is useful for preventing flooding in a multipanel sliding door because it prevents leakage under all of the panels and no gaps can be created at the overlap point of two panels.

The invention includes a method for preventing flooding under a sliding patio door. The method utilizes the device, which is described in this application. The method includes placing the base of such a device in the part of the track that is external to the outer face of the panel of the sliding door. At the same time, the method includes placing the device against the external surface of the sliding door to align the declined portion to decline from the external surface of the sliding door. The method prevents flooding by blocking the gap underneath the bottom of the panel of the sliding door and the top of the track of the sliding door. In addition, the declined surface prevents water from reaching the panel of the sliding door and guides runoff away from the sliding door.

The method for preventing flooding can include filling a space between the external surface of the sliding door to an outer rim of the track with the base of the device. Filling the external portion of the track with the device prevents water from pooling within the track. Without pooled water in the track, wind cannot push water under the panel and into the house.

To help divert water running down the exterior of the panel of the sliding door, the method of preventing flooding can include the step of resting an inner surface of the declined portion against the external surface of the sliding door when placing the base of the device into the track.

The method for preventing flooding can include the step of conforming a bottom surface of the base of the device to a shape of a portion of the track underlying the base. By conforming the bottom of the base of the device over the top of the track, water cannot pool and move under the base of the device even when the top of the track has tracks and a non-flat top surface.

The method for preventing flooding can include the step of providing a declining portion that extends from the external surface of the panel of the sliding door outward at least to the outer rim of the track, if not further. By extending the declining portion, water is directed outside of the track. Directing rain runoff outside the track, prevents water from collecting in the track.

Other features that are considered as characteristic for the invention are set forth in the drawing and preferred embodiment.

Although the invention is illustrated and described herein as embodied in a device for preventing flooding through a sliding patio door, the invention should not be limited to the details shown in those embodiments because various modifications and structural changes may be made without departing from the spirit of the invention.

The construction and method of operation of the invention and additional objects and advantages of the invention is best understood from the following description of specific embodiments when read in connection with the accompanying drawings.

DETAILED DESCRIPTION OF THE INVENTION

Figure 1:
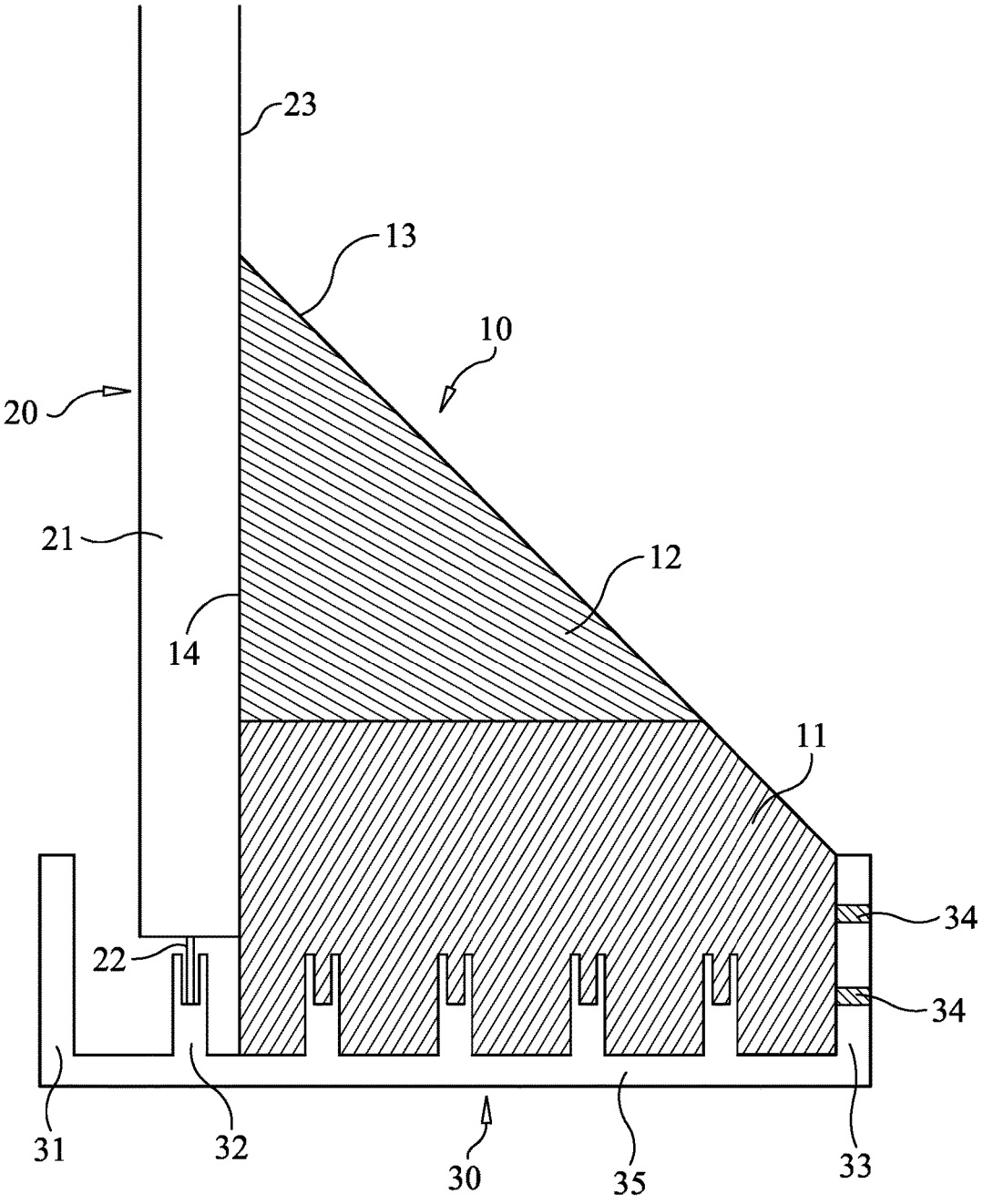
FIG. 1 is a right side sectional view of a device according to the invention for preventing flooding through a sliding patio door.

FIG. 1 shows a device 10 for preventing flooding under a panel 21 of a sliding patio door 20. The device 10 includes a shapeable base 11 and a declined portion 12 that is supported by the shapeable base 11.

Figure 2:
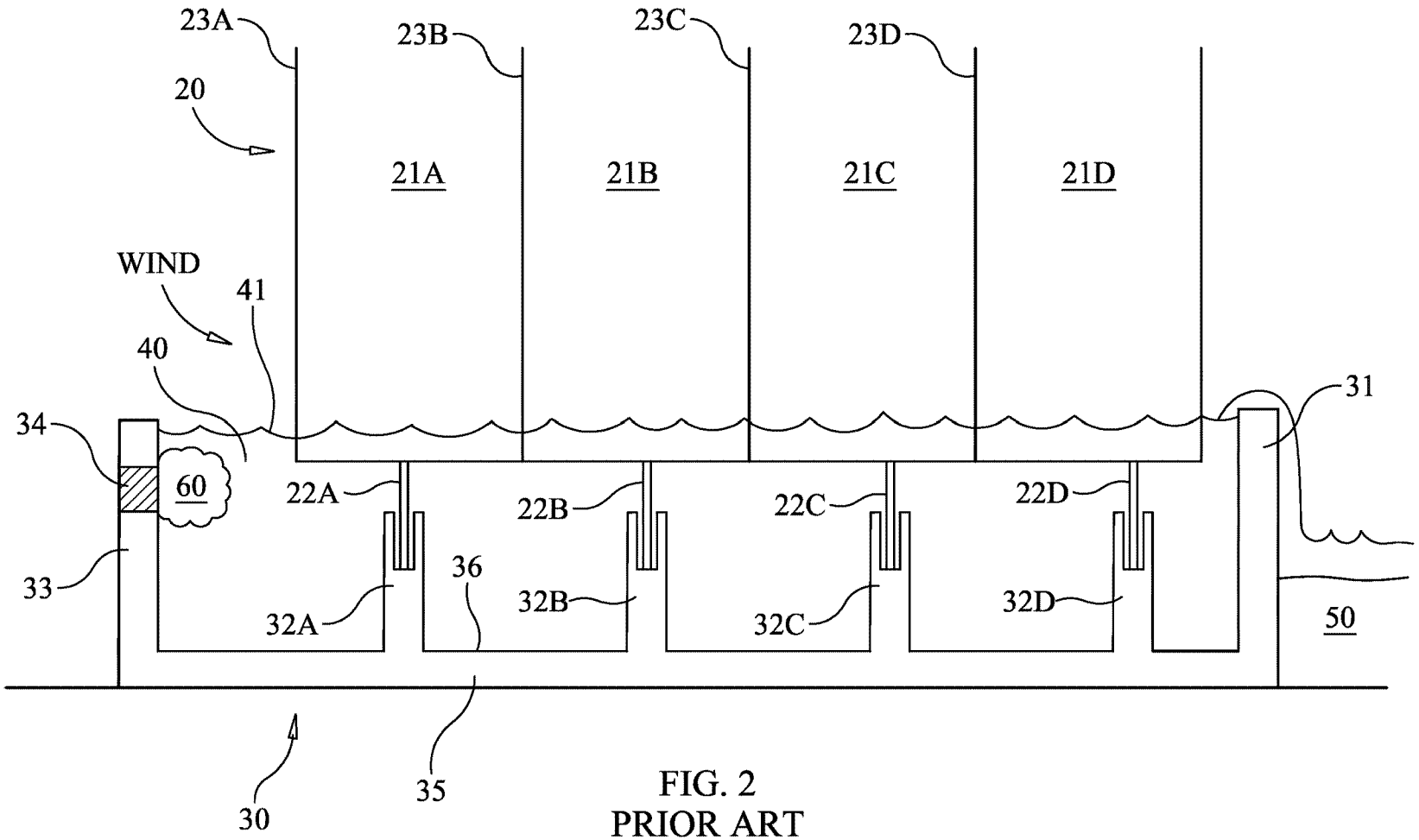
FIG. 2 PRIOR ART
FIG. 2 is a left side view of a sliding door according to the prior art.

In the preferred embodiment shown in FIG. 1, the shapeable base 11 is a sandbag. A bottom surface 17 (see FIG. 5) of the shapeable base 11 conforms to the underlying portion of a top surface 36 (see FIG. 2) of the track 30 to fill the space in the track 30 between the outer face 23 of the door panel 21 and the outer rim 33.

Alternate preferred embodiments of the shapeable base 11, which are not shown, include a bag filled with lead pellets, and a block of clay.

The declined portion 12 is connected to and supported by the shapeable base 11. The declined portion 12 is shaped like a triangular prism running across the width of the sliding door 20 or the door panel 21. A preferred embodiment of the declined portion 12 is a polystyrene foam block. The foam block can be covered with cloth. The declined portion 12 has an inside surface 14 that is a vertical plane that abuts the outer face 23 of the door panel 21. The declined outer surface 13 declines from the top of the inside surface 14 outward and downward toward the outer rim 33 of the track 30. The declined outer surface 13 directs water that would otherwise strike the door panel 21 outward beyond the outer rim 34 to prevent rainwater from accumulating in the track 30.

Figure 3:
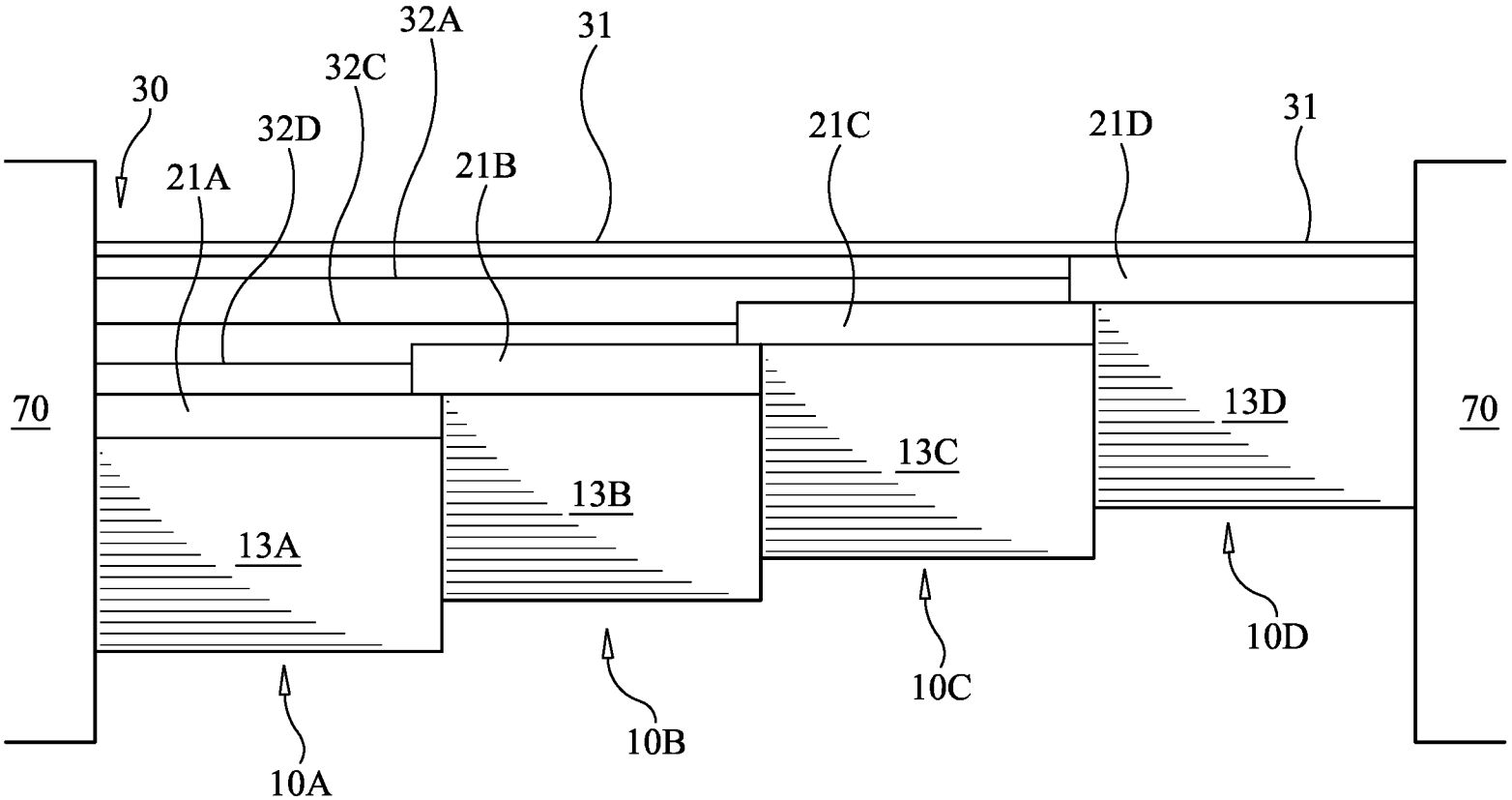
FIG. 3 is a top elevational view of an assembly of device installed to prevent flooding under a sliding door.
Figure 4:
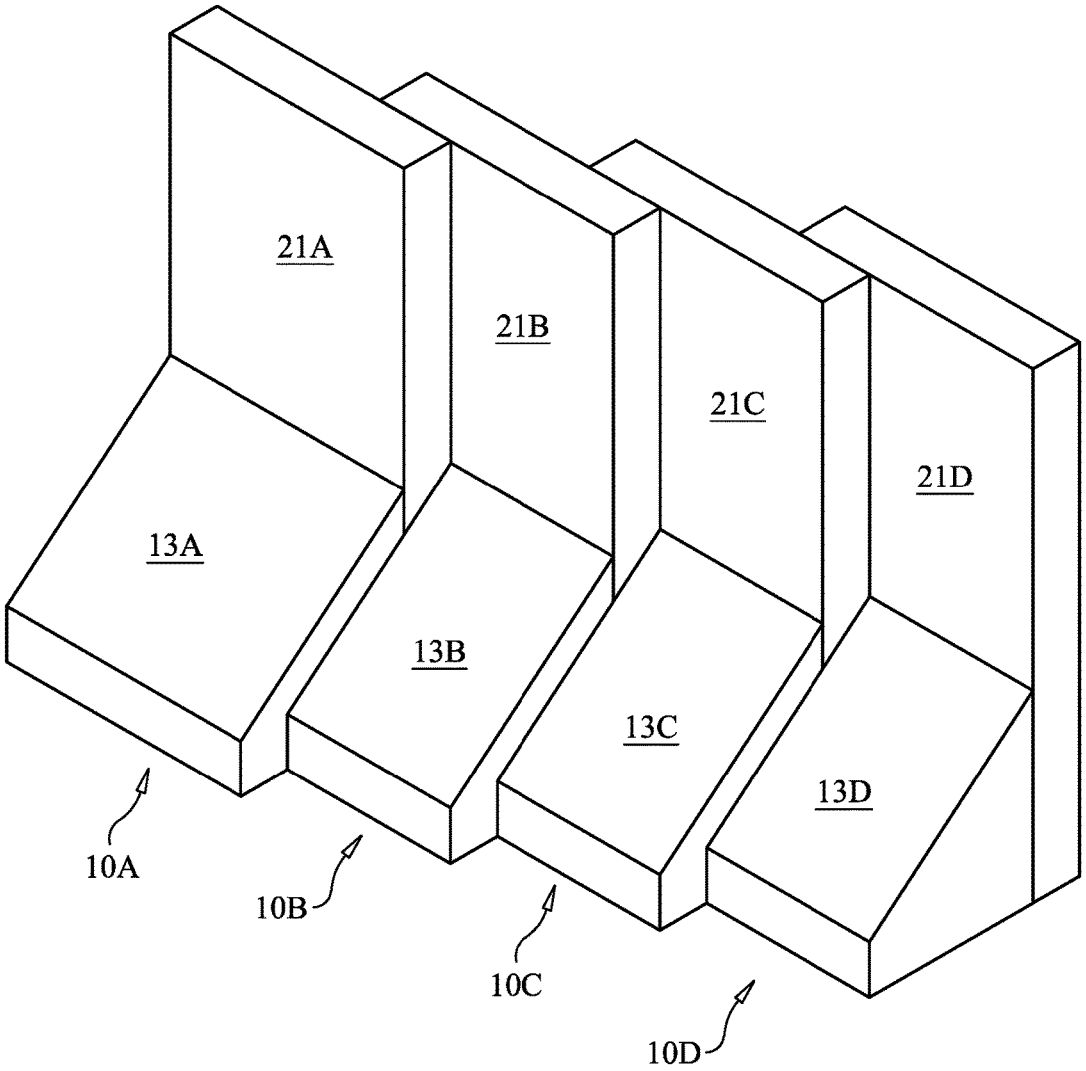
FIG. 4 is a left front perspective view of an assembly for preventing flooding, which is installed in a sliding door.

FIGS. 3-4 show an assembly for preventing flooding through a door 20 seated between walls 70 of a building. In the embodiment shown in FIGS. 3-4, the assembly includes four (4) devices 10A, 10B, 10C, and 10D. The devices 10A, 10B, 10C, and 10D each abut a respective one of the door panel 21A, 21B, 21C, and 21D. The devices 10A, 10B, 10C, and 10D are placed with their vertical inner surfaces against the outer faces of the door panels 21A, 21B, 21C, and 21D. The bottom of the reshapeable base of the device is seated on the track.

Device 13D has a depth that equals the distance from the outer surface of door panel 21 to the outer rim 33. When the device 13D is placed in the track 30, the device 13D fills the portion of the track between the outer face of the door panel 21D and the outer rim 33. The declined outer surfaces 13A, 13B, 13C, and 13D of the devices 10A, 10B, 10C, and 10D extend at least to the outer rim 33. As a result, the declined outer surfaces 13A, 13B, and 13C, and 13D divert any rainwater striking the outer surface of the door panels 21A, 21B, 21C, and 21D outside the track, beyond the outer rim 33.

In the case of devices 13A, 13B, and 13C, the devices 13A, 13B, and 13C have a depth greater than a distance from an outer surface of the respective door panels 21A, 21B, and 21C to the outer rim 33. As a result, when the devices 13A, 13B, and 13C are placed on the track with their vertical inner surfaces contacting the outer face of the door panels 21A, 21B, and 21C, a front edge of the devices 21A, 21B, and 21C extends outward, beyond the outer rail 33. Because the base of the devices 13A, 13B, and 13C is a sandbag, which is a reshapeable material, the devices can cover the outer rail 33 and rails 32 and still conform to the underlying portion of the top surface of the track 30.

Figure 5:
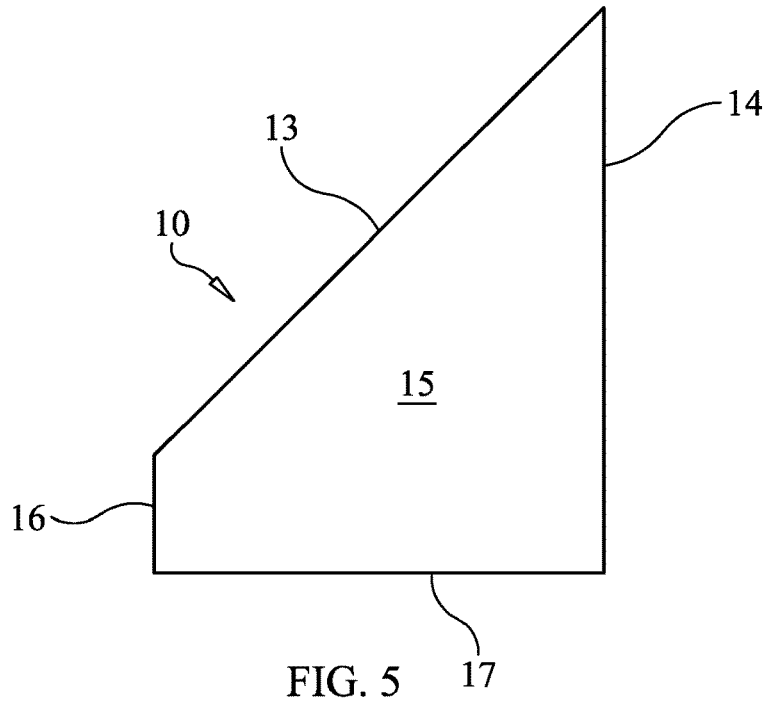
FIG. 5 is a left elevational view of the device shown in FIG. 1.
Figure 6:
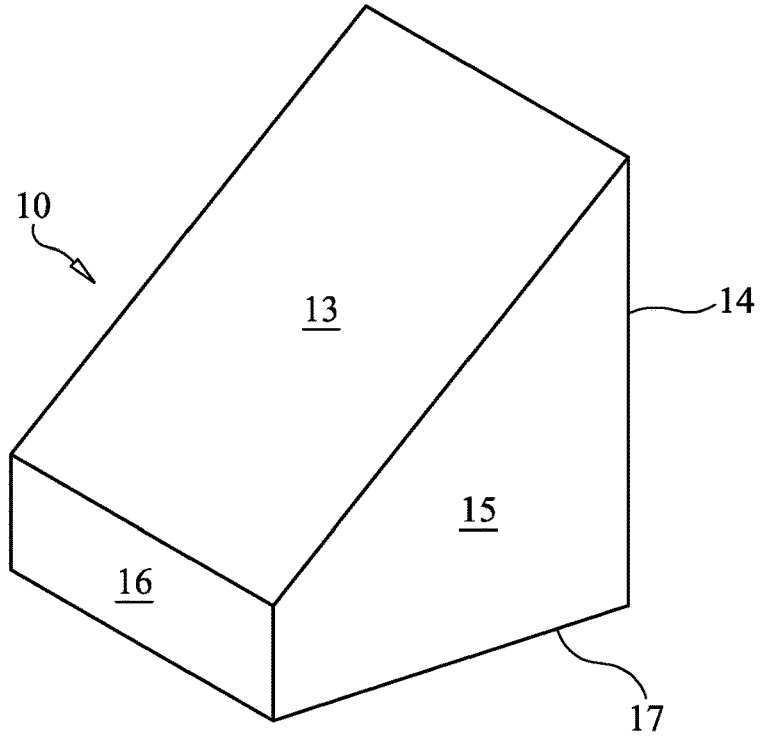
FIG. 6 is a front, left, top elevational view of the device shown in FIG. 5.

FIGS. 5 and 6 show a preferred embodiment of the device 10. The device 10 has a bottom surface 17 that is reshapeable to allow the bottom surface 17 to conform to the shape of any underlying surface. The base includes a sandbag that weighs eighteen kilograms. In a preferred embodiment, the depth (i.e. front to back) of the bottom surface 17 is at least equal to the distance from the outer surface of a door panel to the outer rim of a track.

The device includes a vertical inner surface 14. The vertical inner surface 14 is configured to abut the outer face of a door panel when installed. In a preferred embodiment of the device, the vertical inner surface 14 is sixty centimeters (60 cm) tall.

The device 10 has a front surface 16. A width (i.e. right to left) of the front surface 16 in one preferred embodiment is as wide as sliding door to be protected. In an embodiment, that utilizes an assembly of multiples devices, where each device is to protect a respective door panel of a sliding door, the width of each device is approximately equal to the width of the door panel being protected. "Approximately" is used to recognize that the device might be slightly narrower than its panel because the panels in a sliding door overlap each other slightly.

The invention claimed is:

1. A device for preventing flooding under a sliding door, the device comprising:

the sliding door having an external face, the sliding door being laterally slideable within a track, the track having a base plate and an outer rim being disposed on the base plate external to the external face;

a base being configured to rest in the track outside the external face, said base being reshapeable to conform to at least one rail in the track; and a declined portion being supported by and connected to said base, wherein an inner surface of said declined portion being configured to rest flush against the external face of the sliding door, said declined portion having a declined outer surface, said declined outer surface being configured to decline from the external face when said base is resting in the track and said declined portion is resting against the outer face.

2. The device according to claim 1, wherein said base and said declined portion are impervious to water.

3. The device according to claim 1, wherein said base is reshapeable to conform to a plurality of rails.

4. The device according to claim 1, wherein said base includes a bag and particles filling said bag.

5. The device according to claim 4, wherein said particles include sand.

6. The device according to claim 1, wherein said base has a depth, said depth being at least as great as a depth between the external face of the sliding door and the outer rim.

7. The device according to claim 1, wherein said base has a width equal to a width of the sliding door.

8. The device according to claim 1, wherein said base and said declined portion have a combined height greater than a height of a gap between the track and a bottom of the sliding door.

9. An assembly for preventing flooding under a sliding door, the assembly comprising:

the sliding door having an inner panel and an outer panel, the inner panel having an external face, and the outer panel having an external face, the inner panel and the outer panel being laterally slideable relative to each other within a track, the track having a base plate and an outer rim being disposed on the base plate external to the external face of the outer panel and to the external face of the inner panel;

a first device for preventing flooding under the inner panel, said first device including:

a base being configured to rest in the track outside the external face of the inner panel, said base being reshapeable to conform to at least one rail in the track; and a declined portion being supported by and connected to said base, wherein an inner surface of said declined portion being configured to rest flush against the external face of the inner panel, said declined portion having a declined outer surface, said declined outer surface being configured to decline from the external face of the inner panel when said base is resting in the track and said declined portion is resting against the outer face of the inner panel; and a second device for preventing flooding under the outer panel, said second device including:

a base being configured to rest in the track outside the external face of the outer panel, said base being reshapeable to conform to at least one rail in the track; and a declined portion being supported by and connected to said base, wherein an inner surface of said declined portion being configured to rest flush against the external face of the outer panel, said declined portion having a declined outer surface, said declined outer surface being configured to decline from the external face of the outer panel when said base is resting in the track and said declined portion is resting against the outer face of the outer panel.

10. A method for preventing flooding under a sliding door, the method which comprises:

providing a device having a base and a declined portion, said base being reshapeable to conform to at least one rail in a track, wherein the sliding door has an external surface and being configured to travel laterally within the track, and said declined portion being supported by and connected to said base, said declined portion having a declined outer surface;

placing said base in the track against the external surface of the sliding door, wherein an inner surface of said declined portion being configured to rest flush against the external face of the sliding door, while aligning said declined portion to decline from the external surface of the sliding door.

11. The method according to claim 10, which further comprises filling a space between the external surface of the sliding door to an outer rim of the track with said base when placing said base.

12. The method according to claim 10, which further comprises resting an inner surface of said declined portion against the external surface of the sliding door when placing said base.

13. The method according to claim 10, which further comprises conforming a bottom surface of said base to a shape of a portion of the track underlying said base when placing said base in the track.

14. The method according to claim 10, wherein said declined portion has a depth at least as great as a distance from the external surface of the sliding door to an outer rim of the track.

* * * * *